United States Patent [19]

Okamoto

[11] 4,071,548

[45] Jan. 31, 1978

[54] LUBRICATING OIL ADDITIVE, PROCESS FOR THE SYNTHESIS THEREOF AND LUBRICATING OIL ADDITIVE COMPOSITION

[75] Inventor: Nobukazu Okamoto, Ohimachi, Japan

[73] Assignee: Toa Nenryo Kogyo Kabushiki Kaisha, Tokyo, Japan

[21] Appl. No.: 714,320

[22] Filed: Aug. 16, 1976

Related U.S. Application Data

[62] Division of Ser. No. 310,095, Nov. 28, 1972, Pat. No. 3,991,098.

[30] Foreign Application Priority Data

Nov. 30, 1971 Japan ..... 46-96580
Nov. 30, 1971 Japan ..... 46-96581

[51] Int. Cl.[2] ..... C07F 5/04

[52] U.S. Cl. ..... 260/462 R; 252/49.6; 252/51.5 A

[58] Field of Search ..... 260/462 R; 252/51.5 A, 252/49.6

[56] References Cited

U.S. PATENT DOCUMENTS 3,282,955 11/1966 Le Suer ..... 252/49.6 X
3,533,945 10/1970 Vogel ..... 252/49.6

*Primary Examiner*—Helen M. S. Sneed

*Attorney, Agent, or Firm*—Blanchard, Flynn, Thiel, Boutell & Tanis

[57] ABSTRACT

The invention comprises an ashless additive (I) of the formula:

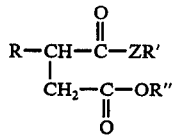

(I)

in which

Z is oxygen or nitrogen.

R is alkyl or alkenyl of more than 40 carbon atoms, inclusive,

R′ is $—(R'''OH)_2$ when Z is nitrogen or $(R'''O)_mH$ when Z is oxygen,

R″ is $—R'''NH(R'''OH)$ or $—(R'''0)_mH$ or mixtures thereof,

R‴ is an alkylene group of 2–3 carbon atoms,

*m* is 5 to 20;

or (II) the corresponding boric acid esters;

or (III) the corresponding boric acid ester of the reaction product of polyalkenylsuccinic anhydride and a N,N,N′-tris (polyoxyalkylene) alkylalkylenediamine;

for use in lubricating oils, to methods for preparing the additives, and to lubricating compositions containing the additives.

1 Claim, No Drawings

LUBRICATING OIL ADDITIVE, PROCESS FOR THE SYNTHESIS THEREOF AND LUBRICATING OIL ADDITIVE COMPOSITION

This is a division of application Ser. No. 310,095, filed Nov. 28, 1972, now U.S. Pat. No. 3,991,098.

BACKGROUND OF THE INVENTION

It has been well known that in the lubrication of an internal-combustion engine in which a lubricating oil containing a lubricating oil additive (i.e. detergent-dispersant) containing a metal is used, a disadvantage is felt due to ash remaining after the combustion of the lubricating oil. Therefore, an ashless additive is normally used in place of the metal-containing additive. Ashless detergent-dispersants comprising succinic imide or hydroxybenzylamine have been commercially available.

The fact that the ether group solubilizes a metal or a metal ion has been known since Grignard reagents were found. It has also been known that, if a polyalkylene glycol is added to a lubricating oil for use in an internal-combustion engine, the efficiency and deterging power thereof are increased. However, this technique has not been used practically, because the solubility of polyalkylene glycols in mineral oils is poor.

SUMMARY OF THE INVENTION

New polyether additives and polyether-boron additives of the present invention have excellent antioxidative and anticorrosive effects in addition to dispersing effect and they have an excellent thermal stability superior to that of conventional, commercial, ashless detergent-dispersants comprising succinic imide or hydroxybenzylamine.

The new ashless detergent-dispersants (lubricating oil additives) of the present invention can be represented by the following general formulae (I), (II) and (III):

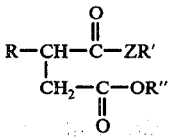

(I)

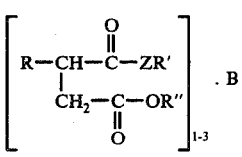

(II)

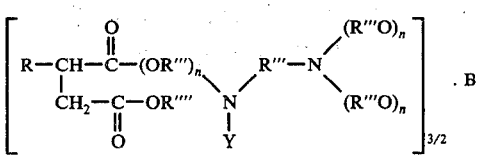

(III)

wherein:

R represents an alkyl or alkenyl group of more than 40 carbon atoms inclusive,

R′ represents a group of general formula $—(R'''OH)_2$ when Z is nitrogen or a group of general formula $—(R'''O)_mH$ when Z is oxygen, R″ represents a group of general formula —R‴NH(R‴OH) or $—(R'''O)_mH$, R‴ represents an alkylene group of 2 or 3 carbon atoms, R⁗ represents —H or a group of general formula —R‴NH(R‴OH), Y represents an alkyl group, having from 1 to 20 carbon atoms

*n* represents a number of 3–8, and

*m* represents a number of 5–20.

The compounds of general formula (I) are products obtained by reacting an intermediate product obtained from a polyalkenylsuccinic anhydride and a polyalkylene glycol with a secondary (or di-) alkanolamine. The compounds of general formula (II) are mixtures of boric acid esters obtained by treating the compounds of general formula (I) with boric acid or boric anhydride. These boric acid esters are assumed to have a structure in which 1–3 mols of said compound (I) are combined with 1 mol of boron. The compounds of general formula (III) are products obtained by treating with boric acid or boric anhydride intermediate products obtained by treating polyalkenylsuccinic anhydrides [starting compounds of the compounds of general formula (I)] with N,N,N′-tris (polyoxyalkylene) alkylalkylenediamines or further with a secondary (or di-) alkanolamine.

It is to be noted that by using the new compounds of general formulae (I)–(III) of the present invention, the same effect as that obtained by dissolving a polyalkylene glycol in a mineral oil can be obtained. It has been known that boron is added to various petroleum products because of its antioxidative action and deterging-dispersing action. In this connection, according to the present invention, effective amounts of both polyether and boron can be incorporated in the form of just a single compound in petroleum products by employing compound (II) or (III).

The process for synthesizing the novel additive materials of this invention is as follows:

An alkyl or alkenyl-substituted succinic anhydride (that is, polyalkenyl succinic anhydride), of the formula:

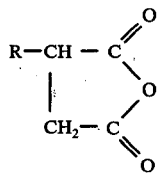

wherein R is an alkyl or an alkenyl group of 40 to 200 carbon atoms is reacted with a polyalkylene glycol of the formula:

$$HOR'''(OR''')_pOH$$

In which R‴ is ethylene or propylene and *p* is an integer 4 to 19 in a molar ratio of 1:(1 to 0.1) at a temperature of 150° C to 220° C to obtain as a first intermediate product a polyalkenylsuccinic acid monoether of said polyalkylene glycol of the formula:

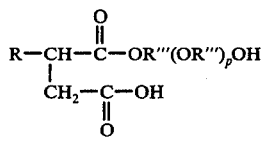

(V)

in which R is an alkyl or an alkenyl group of 40 to 200 carbon atoms, then compound V is reacted with a secondary alkanolamine of the formula:

$$NH(R'''OH)_2$$

in a molar ratio of 1.0 : (0.3 to 1.0) under reduced (subatmospheric) pressure in a temperature range of 150° to 200° C to produce the compound mixture I of

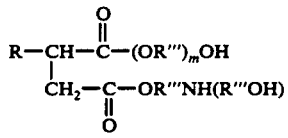

(I')

and a compound of the formula:

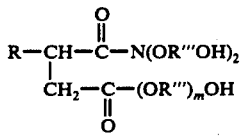

(I'')

in which R and R''' are as defined above and $m$ is 5 to 20.

The relative proportion of I' and I'' making up the mixture I is such that their molal sum equals that of compound V, the starting compound.

Alternately the polyalkenylsuccinic anhydride starting material IV is reacted with N,N,N'-tris-(polyoxyalkylene) alkylalkylenediamines or further reacting this product with said secondary alkanolamine in a molar ratio of 1.0 : (0.3 to 1.0) under reduced (subatmospheric) pressure at a temperature of 150° to 200° C to obtain a product of the formula:

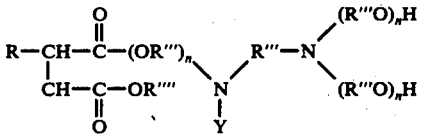

(VI)

wherein R and R''' have the above meanings, R'''' is H or R'''NH(R'''OH), $n$ is 3 to 8 and Y is an alkyl of $C_1$–$C_{20}$.

The above compound VI or I can be reacted with boric acid or boric anhydride in a molar ratio of 1 mole (with regard to polyalkylenesuccinic acid) of the product to 0.3 to 1.0 mole of boric acid or boric anhydride under reduced (subatmospheric) pressure at a temperature of 100° to 200° C to produce:

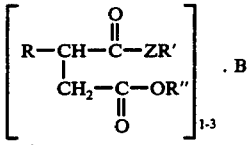

(II)

and

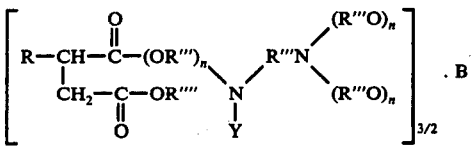

(III)

A process of the present invention for synthesizing the new additives comprises the following 3-step or 4-step basic reactions:

Step 1

Maleic anhydride is reacted with a polyolefin to form a succinic anhydride derivative (polyalkenylsuccinic anhydride) ($IV_a$).

EXAMPLE

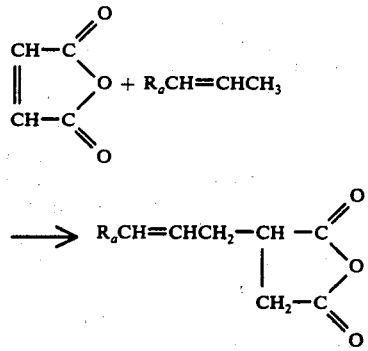

($IV_a$)

wherein $R_a$ represents $(CH_3)_2CH[C(CH_3)_2CH_2]_{n_a}$ ($n_a$ = 10–30) (The same shall apply hereinafter.)

Step 2

Said compound ($IV_a$) is reacted with a polyalkyleneglycol to form compound ($V_a$).

EXAMPLE

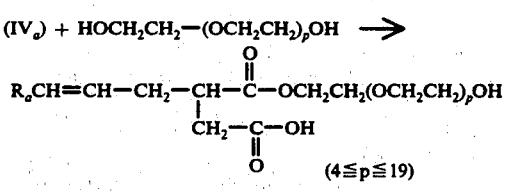

($V_a$)

Step 3

Compound ($V_a$) is reacted with a secondary alkanolamine to synthesize compound ($I_a$).

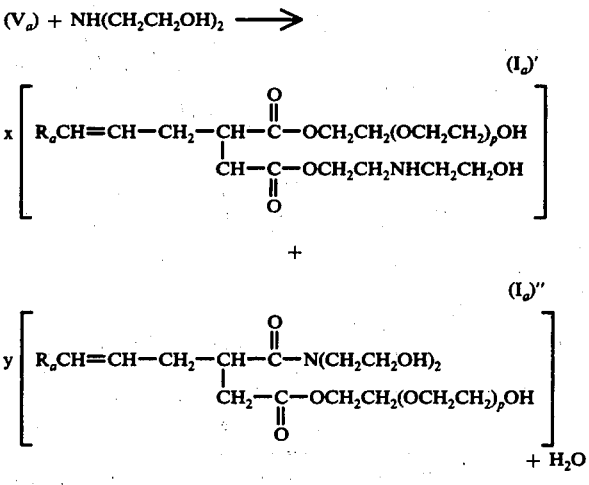

wherein $x + y = 1$ on the molal basis of the reactants.

Compound ($I_a$) comprises a mixture of above compounds ($I_a$)' and ($I_a$)''.

By this reaction, there are caused esterification of the carboxyl group in compound ($V_a$) to form compound ($I_a$)' and simultaneously nucleophilic reaction to the ester bond of the secondary amine (diethanolamine in the above example) to cut the ester bond contained in compound ($V_a$) thereby forming the amide bond [compound ($I_a$)''] and polyethylene glycol. Polyethylene glycol once liberated forms an ester bond with the carboxyl group contained in compound ($V_a$), which is again taken in the polyalkenylsuccinic amide molecule to form compound ($I_a$)''. The amidation reaction proceeds more rapidly than the esterification reaction and, accordingly, relative quantities of ($I_a$)' and ($I_a$)'' formed in step 3 are considered to be $y>x$ and that product ($I_a$) mainly comprises a mixture of compounds ($I_a$)' and ($I_a$)''. Further, product ($I_a$) is considered to contain intramolecular/intermolecular ester of compounds ($V_a$), ($I_a$)' and ($I_a$)''.

Step 4

Compound ($I_a$) is reacted with a boron compound such as boric acid or boric anhydride to synthesize compound ($II_a$).

EXAMPLE (Reaction mixture of Step 3) + $H_3BO_3 \rightarrow$ ($II_a$), the boric acid ester mixture + $3H_2O$ As easily supposable from the above reaction, procedures, the respective steps can be traced by checking the infrared absorption spectrum of the reaction mixture and solubility thereof in n-pentane. For instance, as for infrared absorption spectrum of compound ($IV_a$), symmetrical $^{\nu}C{=}O$ and asymmetrical $^{\nu}C{=}O$ appear at 1870(m) and 1790(s)$cm^{-1}$, respectively. After the completion of the reaction in step 2 to form compound ($V_a$), these two absorptions disappear and a new $^{\nu}C{=}O$ appears at 1750$cm^{-1}$. Generally, the reaction in Step 2 is completed within 2-3 hours at 150°-220° C. The reaction product in step 3 has $^{\nu}C{=}O$ corresponding to ester and amide at 1750 and 1650$cm^{-1}$, respectively and $^{\nu}OH$ at ~3450$cm^{-1}$. If free polyalkylene glycol remains, the n-pentane solution becomes turbid upon cooling. In step 4, $^{\nu}OH$ at ~3450$cm^{-1}$ is traced. The changes in infrared absorption spectra are shown in Table 1.

Table 1

| | $^{\nu}C{=}O$ and $^{\nu}OH$ in each reaction step | |
|---|---|---|
| | $^{\nu}C{=}O$, $cm^{-1}$ | $^{\nu}OH$,$cm^{-1}$ |
| Step 1 | 1870, 1790 | — |
| Step 2 | 1750 | ~3450 |
| Step 3 | 1750, 1650 | ~3450 |
| Step 4 | 1750, 1650 | — |

Compound (III) can be obtained by changing steps 2, 3 and 4 of the process of the present invention as follows:

Step 2

Compound ($IV_a$) is reacted with an N, N, N'-tris (polyoxyalkylene) alkylalkylenediamine to obtain a compound ($V_b$) corresponding to compound (V).

EXAMPLE

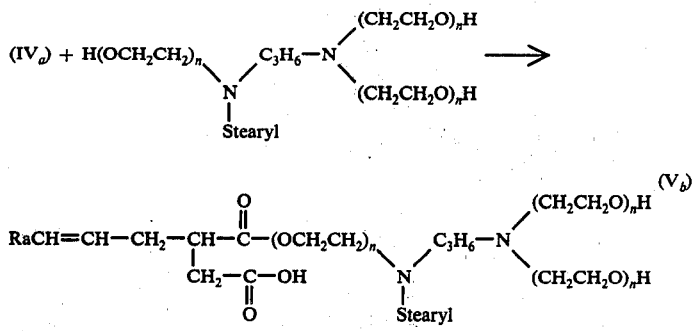

Step 3

The compound ($V_b$) is reacted with a secondary alkanolamine to obtain compound ($I_b$).

EXAMPLE

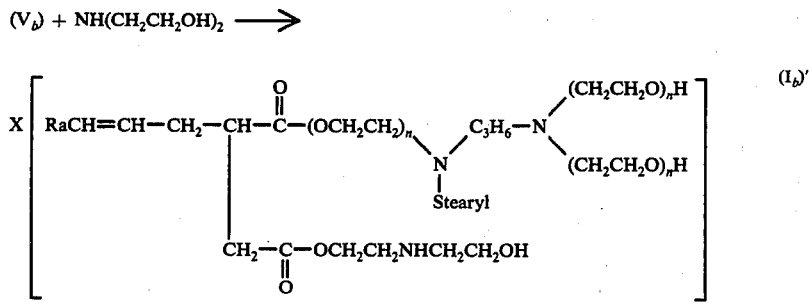

-continued $(I_b)''$

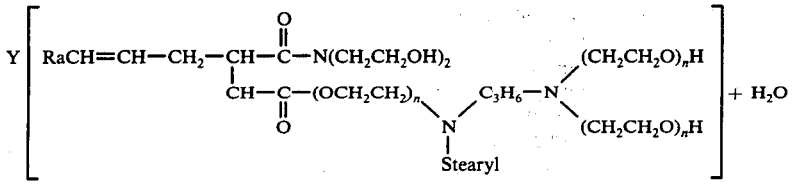

compound $(I_b)$ comprises a mixture of above compounds $(I_b)'$ and $(I_b)''$. $3n = 10$ Step 4

The compound $(I_b)$ is reacted with boric acid or boric anhydride to synthesize compound $(III_b)$.

EXAMPLE (Reaction Mixture of Step 3) + $H_3BO_3 \rightarrow (II_b)$, the boric acid ester mixture + $H_2O$ In case an N, N, N'-tris (polyoxyalkylene) alkylalkylenediamine is used, the reaction of step 3 may be omitted. Further, the absorption peak values given in Table 1 are also illustrative of the products in these modified steps 2, 3 and 4.

The process for synthesizing the additives of the present invention will be illustrated below by way of examples, wherein the reactions were carried out under static or dynamic nitrogen atmosphere.

DESCRIPTION OF PREFERRED EMBODIMENTS

EXAMPLE 1

Step 1

In a 500 ml three-neck, round-bottom flask, 300 g of polybutene (average molecular weight 1080) and 60g of maleic anhydride were charged and the whole was heated to 160°–200° C under stirring. After the reaction for about 24 hours, the mixture was air-cooled and added with 300ml of n-pentane. The n-pentane solution was filtered and n-pentane was distilled out with a rotary evaporator. The residue was transferred into a glass sublimation apparatus and heated to about 200° C under vacuum to remove unreacted maleic anhydride and a trace amount of the solvent. Yield of thus obtained polybutenylsuccinic anhydride was 90–95%.

Step 2

40 Grams of polyethylene glycol (average molecular weight 400) were added to 118g (corresponding to about 0.1 mole) of the product of Step 1 and the whole was heated to 150°–220° C under stirring to obtain homogeneous solution (transparent). The reaction procedure was traced by measuring infrared absorption spectrum. The reaction was completed after about 3 hours. The product was obtained quantitatively.

Step 3

158 Grams of the product of Step 2 were mixed with 5.3g (0.05 mole) of diethanolamine and the mixture was heated to 150°–180° C under stirring under reduced pressure. In the course of the reaction, the reaction mixture became turbid temporarily because polyethylene glycol was liberated. As the heating and stirring were continued to carry out the esterification reaction, the mixture became transparent again. At that time, a part of the reaction mixture was taken out and dissolved in n-pentane and the solution was ice-cooled. No turbidity was observed and, therefore, the completion of the reaction was proved.

Step 4

The whole quantity of the product of Step 3 was added with 6.2g (0.1 mole) of boric acid and the mixture was heated to 100°–160° C under reduced pressure of 20–50mmHg under stirring. Water formed as the reaction proceeded was collected with a freezing trap and weighed to calculate the amount of generation (about 0.3 mole). Yield 164g × (94%).

EXAMPLE 2

Step 1

Step 1 was carried out in the same manner as in Example 1.

Step 2

118 Grams (corresponding to about 0.1 mole) of the product of Step 1 were added with 20g (0.05 mole) of polyethylene glycol (average molecular weight 400) and the mixture was heated to 220° C under stirring. Infrared absorption spectrum of the reaction mixture was determined to prove that the absorption at 1870 and 1790cm$^{-1}$ had disappeared completely. Thereafter, the heating and stirring were stopped.

Step 3

The whole quantity of the product of Step 2 was added with 5.3g (0.05 mole) of diethanolamine and the mixture was heated to 160° C under stirring. The reaction product showed two $^{\nu}C{=}O$ at 1750 and 1650cm$^{-1}$. The heating and stirring were continued until no more increase in strength of the absorption at 1650cm$^{1}$ was observed.

Step 4

The whole quantity of the product of Step 3 was mixed with 6.2g (0.1 mole) of boric acid and 100ml of toluene and the mixture was heated to a reflux temperature. Water formed by the reaction was removed by azeotropic distillation. After the water formation ceased, toluene was distilled out by vacuum stripping. Yield 142g (99%).

EXAMPLE 3

Step 1

Step 1 was carried out in the same manner as in Example 1.

Step 2

118 Grams (corresponding to 0.1 mole) of the product of Step 1 in Example 1 were added with 55g of polypropylene glycol (average molecular weight 1100)

and the whole was heated to about 200° C under stirring. The heating was continued until absorptions at 1870 and 1790cm$^{-1}$ disappeared in infrared absorption spectrum.

Step 3

The whole quantity (173g) of the reaction product of Step 2 was added with 6.5g (0.05 mole) of diisopropanolamine and the whole was heated to 180° C under reduced pressure under stirring. The completion of the reaction was judged by confirmation of no more change in absorption strength at 1750 and 1650cm$^{-1}$ in infrared absorption spectrum.

Step 4

The whole quantity of the reaction product of Step 3 was added with 3.5g of boric anhydride and the mixture was heated to 150° C under reduced pressure. During the heating, a part of the reaction mixture was taken out at intervals, dissolved in n-pentane and ice-cooled to examine presence of turbidity or precipitate. Said heating was continued until no turbidity or precipitate was observed by this examination method. The product exhibited no absorption of $^{\nu}$OH at ~3450cm$^{-1}$ in infrared absorption spectrum.

EXAMPLE 4

Step 1

Step 1 was carried out in the same manner as in Example 1.

Step 2

118 Grams (corresponding to about 0.1 mole) of the product of Step 1 in Example 1 were added with 25.3g (about 0.033 mole) of N,N,N'-tris (polyoxyethylene) stearylpropylenediamine (trade name: DIAMIET R 310) and the whole was heated to 200° C under stirring. After confirming that absorptions at 1870 and 1790cm$^{-1}$ had disappeared in infrared absorption spectrum of the reaction mixture, the following step was effected.

Step 3

The total quantity of the product of Step 2 was added with 5.3g (0.05 mole) of diethanolamine and the whole was heated to 170° C under reduced pressure under stirring. (Another method may be employed in which the product is treated with 0.03 mole or 0.06 mole of diethanolamine). Infrared absorption spectrum of the reaction mixture was nearly the same as that of the product is the Step 3 of Example 3.

Step 4

The total quantity of the product of Step 3 was added with 6.2g (0.1 mole) of boric acid and the whole was heated to 190° C under reduced pressure under stirring. After boric acid disappeared apparently to yield homogeneous mixture, infrared absorption spectrum of the mixture was measured to confirm that the absorption at ~3450cm$^{-1}$ disappeared. Yield 147g (99%).

In utilizing the polyether or polyether-boron detergent-dispersant obtained according to the process of the present invention as lubricating oil additive for internal-combustion engines, concentration of the detergent-dispersant can be varied over a considerably wide range. Generally, practical effect can be obtained in an amount of 0.5–25 wt. %. Though the effect as detergent-dispersant may be obtained in a concentration of less than 0.5 wt. % or more than 25 wt. %, the concentration should be determined from economical viewpoint and in view of conditions of use of the lubricant to which the additive prepared by the process of the invention is to be added.

The effects of the additives prepared by the process of the present invention will be proved by tests described below. In samples of additives used in the tests, additive A is a reaction product of Step 3 (Example 2), additive B is a reaction product of Step 4 (Example 2), additives 1 and 2 are most powerful commercial ashless detergent-dispersants, i.e. polyalkenylsuccinic imide and polyalkenylhydroxybenzylamine, respectively, and 3 is a control (non-additive).

Test 1: Carbon black dispersion test

As clearly shown in Table 2, an oil containing polyether-boron detergent-dispersant has the highest dispersibility. Particularly, the dispersibility is remarkable with a dispersant concentration of around 0.5 wt. %.

Table 2

| Results of carbon black dispersion test | | | | | |
|---|---|---|---|---|---|
| | | 25° C | | 100° C | |
| Additive | Concentration (Wt. %) | Time | Darkness of supernatant liquid (a) | Time | Darkness of supernatant liquid (a) |
| A | 0.5 | 50< | ++++ | 50< | +++ |
| A | 0.2 | 50< | ++++ | 50< | ++ |
| B | 0.5 | 50< | ++++ | 50< | ++++ |
| B | 0.2 | 50< | ++++ | 50< | +++ |
| 1 | 0.5 | 50< | ++++ | 50< | ++ |
| 2 | 0.5 | 50< | ++++ | 50< | ++ |
| 3 | — | 3 | — | 0.2 | — |

(The oil x shown in Table 3 was used)
(The numerals show time (hr.) required for complete precipitation of carbon black; 0.2 wt. % carbon black was added.)
(a) Darkness and dispersibility increase as number of symbols "+" increases.

Test 2: Oxidation stability test

Table 3 shows properties of base oils used in oxidation stability test according to the specification of JIS K 2514. In fact, the test sample was prepared from a mixture of $x : y = 80 : 20$ vol. % in Tables 4, 5, 6 and 7.

Table 3

| Properties of base oils used in oxidation stability test | | x | y |
|---|---|---|---|
| Specific gravity (15/4° C) | | 0.861 | 0.887 |
| Flash point (° C) | | 218 | — |
| Viscosity (cst) | 37.8° C | 26.21 | 142.2 |
| | 98.9° C | 4.79 | 13.84 |
| Viscosity index | | 113 | 102 |

Tables 4, 5 and 6 show the results of comparative tests of oil samples containing additives A and B synthesized in Example 2 and the above described, commercial ashless detergent-dispersants 1 and 2. The oxidation stability test was effected according to the specification of JIS K 2514.

Table 7 shows the results of oxidation stability test of oil samples which were prepared in such a manner that 2.0 wt. % of the reaction product [A'] of Step 3 in Example 1 (The product which is not reacted with boric acid. Ashless detergent-dispersants of the general formula (I) described in the present specification), 2.0 wt. % of the reaction product [B'] of Step 4 in Example 1 (The product which is reacted with boric acid. Detergent-dispersants of the general formula (II) described in the present specification) and 2.0 wt. % of the reaction product [C] of Step 4 in Example 4 were separately added to the lubricating base oils described in Table 3.

Table 4

[Test 2 - 1] The results of tests at 165.5° C for 72 hours:

| Sample (a) | Additive | Conc. Wt. % | Viscosity ratio (b) | Increase in total acid value (KOHmg/g) | Lacquer | Insoluble matter (g/100g) n-pentane | n-pentane-Coag. (c) |
|---|---|---|---|---|---|---|---|
| 1 | A | 2.0 | 1.196 | | Thin adhesion | 1.540 | 1.869 |
| 2 | A | 0.7 | 1.100 | | " | 0.851 | 0.931 |
| 3 | B | 2.0 | 1.010 | 2.10 | not adhered | 0.223 | 1.558 |
| 4 | B | 0.7 | 1.050 | 2.50 | " | 0.832 | 1.919 |
| 5 | 1 | 2.0 | 1.253 | 3.43 | Thin adhesion | 2.658 | 4.153 |
| 6 | 2 | 2.0 | 1.765 | 1.82 | " | 5.281 | 6.679 |

(a) All samples do not contain any additive other than 1.0 wt. % of zinc dialkyldithiophosphate and an additive to be tested.
(b) Viscosity after the test/viscosity prior to the test.
(c) 1 wt. % n-butyldithianol solution.

[Test 2 - 2] Results of test at 165.5° C for 48 hours

Table 5 shows the results of test of oil samples in which additive A or B had been incorporated to yield practical general multigrade motorcar engine oil. Samples 1 through 4 contain a zinc dialkyl dithiophosphate, a rust inhibitor, an agent for increasing viscosity index, a pour point depressant and detergent-dispersant A or B prepared according to the present invention or commercial detergent-dispersant 2 in a predetermined quantity.

Table 5

| Sample | Additive | Conc. Wt. % | Viscosity ratio | Increase (a) in total acid value (KOHmg/g) | Lacquer | Insoluble matter (g/100g) n-pentane | n-pentane -Coag. |
|---|---|---|---|---|---|---|---|
| 1 | A | 2.0 | 0.991 | −0.22 | Not adhered | 0.0 | 0.647 |
| 2 | B | 2.0 | 1.035 | −0.60 | " | 0.0 | 0.746 |
| 3 | B | 0.7 | 1.024 | −0.17 | " | 0.0 | 0.783 |
| 4 | 2 | 2.0 | 0.997 | −0.57 | " | 0.0 | 0.873 |

(a) "−" represents decrease in total acid value.

Table 6

[Test 2 - 3] Results of tests at 165.5° C for 64 hours:

Table 6 shows the results of the same test as said test 2 - 2 except that time was 64 hours.

| Sample | Additive | Conc. Wt. % | viscosity Ratio | Increase in total acid value (KOHmg/g) | Lacquer | Insoluble matter (g/100g) n-pentane | n-pentane -Coag. |
|---|---|---|---|---|---|---|---|
| 1 | A | 2.0 | 1.085 | 2.72 | Thin adhesion | 1.254 | 2.702 |
| 2 | B | 2.0 | 1.078 | 2.97 | Not adhered | 0.891 | 2.570 |
| 3 | B | 1.0 | 0.997 | 1.28 | " | 0.048 | 1.429 |
| 4 | 1 | 2.0 | 1.125 | 2.87 | Within adherent layer | 1.652 | 3.364 |
| 5 | 2 | 2.0 | 1.092 | 2.77 | Thin adhesion | 0.913 | 2.594 |

Table 7

[Test 2 -4]

Dry air of 10 l per hour was passed to 25 ml of oil samples at 160° C for the period of 48 hours in the presence of lead, aluminum copper and iron catalysts.

| Sample | Additive | Viscosity Initial | Viscosity Final | (a) Increase ratio in viscosity | Acid value Initial | Acid value Final | Increase in total acid (KOHmg/g) | Loss in lead weight (mg) | sludge | Appearance of oils used |
|---|---|---|---|---|---|---|---|---|---|---|
| 1 | A' | 9.465 | 9.721 | 1.03 | 2.1 | 2.9 | 0.8 | 6.3 | nil | transparent |
| 2 | B' | 9.500 | 9.573 | 1.01 | 2.0 | 2.1 | 0.1 | 2.1 | nil | transparent |
| 3 | C | 9.654 | 9.751 | 1.01 | 2.0 | 2.4 | 0.4 | 4.6 | nil | transparent |
| 4 | 1 (b) | 9.672 | 10.301 | 1.06 | 2.0 | 4.7 | 2.7 | 14.5 | nil | turbid |

(a) Ratio of viscosity after test (cSt at 98.9° C)/viscosity before test (cSt at 98.9° C).
(b) Presumed to be a commercial additive, polyalkenylhydroxybenzyl amines.

From Tables 5 and 6, it is noted that the sample oil containing additive A or B prepared according to the present invention has a total acid value lower than that of conventional one within 48 hours. Under the test conditions employed, break point of oil resides between 48 hours and 72 hours (estimated from the curves of increasing total acid number) and lacquer-preventing effect of additives A and B is remarkable, while with the conventional additive, lacquer is formed within 64 hours.

Examples of lubricating oil compositions of the present invention will be shown.

EXAMPLE 5

A composition of the present invention was obtained by adding the following components to a sample oil comprising oil 1 and base oil 2 in a ratio of 80 : 20:

| | |
|---|---|
| Detergent-dispersant of the invention (obtained in Example 1; the same shall apply hereinafter) | 2.0 wt. % |
| Zinc dialkyldithiophosphate | 1.0 wt. % |
| Rust inhibitor | 0.1 wt. % |
| Viscosity index-increasing agent | 4.0 wt. % |
| Pour point depressant | 1.5 wt. % |

-continued

| | |
|---|---|
| Viscosity index-increasing agent | 4.0 wt. % |
| Pour point depressant | 1.5 wt. % |

Properties of base oils used in Example 1 and the comparative example are shown in Table 1 - 1 and effects of the lubricating oil composition are shown in comparison with those of the conventional one in Table 1 - 2.

Table 1 - 1

| | Specific gravity (15/4° C) | Flash point (° C) | Viscosity (cst) 27.8° C | Viscosity (cst) 98.9° C | Viscosity index |
|---|---|---|---|---|---|
| Properties of base oil 1 | 0.861 | 218 | 26.21 | 4.79 | 118 |
| Properties of base oil 2 | 0.887 | — | 142.2 | 13.84 | 102 |

Table 1 - 2

| | | | | Composition of the present invention | Conventional composition |
|---|---|---|---|---|---|
| Neutralization value (KOHmg/g) JIS K 2502 | | | | 2.3 | 3.8 |
| viscosity | 100° F | cst | | 59.74 | 61.49 |
| Results of carbon black dispersion test (the numerals show time (hr.) required for complete precipitation of carbon black : 0.2 wt. % of carbon black added) Note 3 | 25° C | Time | | 50< | 50< |
| | | Darkness of supernatant liquid a | | ++++ | ++++ |
| | 100° C | Time | | 50< | 50< |
| | | Darkness of supernatant liquid | | ++++ | ++ |
| | | Viscosity ratio d | | 1.035 | 0.997 |
| Results of oxidation stability test JIS K 2514 | 165.5 ° C 48 hrs. | Increase in total acid value b (KOHmg/g) | | −0.60 | −0.57 |
| | | Lacquer | | Not adhered | Not adhered |
| | | Insoluble matter (g/100 g) | n-pentane | 0.0 | 0.0 |
| | | | n-pentane c-Coag | 0.746 | 0.873 |
| | | Viscosity ratio | | 1.078 | 1.092 |
| Results of oxidation stability test JIS K 2514 | 165.5 ° C 64 hrs | Increase in total acid value (KOHmg/g) | | 2.97 | 2.77 |
| | | Lacquer | | Not adhered | Thin adhesion |
| | | Insoluble matter | n-pentane | 0.891 | 0.913 |
| | | g/100 g) | n-pentane-Coag | 3.570 | 2.594 |

a Darkness and dispersibility increase as number of symbol ~ "+" increases.
b "−" represents decrease in total acid number.
c 1 wt. % n-butyldithianol solution.
d Viscosity after the test/viscosity prior to the test.

COMPARATIVE EXAMPLE

A conventional composition was obtained by adding the following components to a sample oil comprising base oil 1 and base oil 2 in a ratio of 80 : 20:

| | |
|---|---|
| Commercial ashless detergent-dispersant, polyalkenyloxybenzylamine | 2.0 wt. % |
| Zinc dialkyldithiophosphate | 1.0 wt. % |
| Rust inhibitor | 0.1 wt. % |

EXAMPLE 6

A composition of the present invention was obtained by adding the following components to a sample oil [solvent purified oil comprising a mixture of 55 vol. % of 350 N (95 V.I.) and 45 vol. % of 700 N (95 V.I.)]:

| | |
|---|---|
| Detergent-dispersant of the invention | |

-continued

| | |
|---|---|
| (obtained in Example 1) | 1.2 wt. % |
| Zinc dialkyldithiophosphate | 0.6 wt. % |
| Ultrabasic dispersant | 0.8 wt. % |
| Pour point depressent | 0.1 wt. % |

Test 3 was carried out by using the above composition.

Test 3: Caterpillar-L-1 engine test (Supplement 1)

An engine test was carried out for examining piston-deterging effect of the composition of the present invention. The results are shown in Table 11.

Table 11

| Caterpillar-L-1 engine test (Supplement 1) | | |
|---|---|---|
| Time | Top-ring group filling (%) | Lacquer* |
| 120 | 5.9 | 1.4 |
| 480 | 13.6 | 2.4 |

*Demerit Rating

As shown in the Table, Top ring group filling was 13.6% (480 hours) and stood the test.

The embodiments of the invention in which an exclusive property or privilege is claimed are defined as follows:

1. A lubricating oil additive composition comprising a reaction product obtained by I. reacting A. an alkyl- or alkenylsuccinic anhydride of the formula

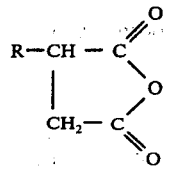

wherein R is alkyl or alkenyl having from 40 to 200 carbon atoms, with

B. polyethylene glycol or polypropylene glycol of the formula $HOR'''(OR''')_pOH$ wherein both R''' in the formula are the same and wherein R''' is ethylene or propylene, and $p$ is an integer from 4 to 19 at a molar ratio of A:B in the range of 1:1 to 1:0.1, at a temperature in the range of 150° to 220° C, until the infrared absorptions for $\nu_{C=O}$ at 1870cm$^{-1}$ and 1790cm$^{-1}$ disappear, an infrared absorption for $\nu_{C=O}$ is present at 1750cm$^{-1}$, and an infrared absorption for $\nu_{OH}$ is present at about 3450cm$^{-1}$, to obtain a first intermediate product, and then II. reacting said first intermediate product with C. a secondary alkanolamine of the formula $NH(R'''OH)_2$ wherein R''' is as defined above at a molar ratio of said first intermediate product:C in the range of 1:0.3 to 1:1, under reduced pressure, at a temperature in the range of from 150° to 200° C, until infrared absorptions are present for $\nu_{C=O}$ at 1750cm$^{-1}$ and 1650cm$^{-1}$, an infrared absorption is present for $\nu_{OH}$ at about 3450cm$^{-1}$ and no turbidity is observed when the reaction mixture is dissolved in n-pentane and is cooled, and then III. reacting the product of step II with boric acid or boric acid anhydride at a molar ratio of from 0.3 to one mole of boric acid or boric acid anhydride per one mole of A, under reduced pressure, at a temperature of 100° to 200° C until the infrared absorption for $\nu_{OH}$ at about 3450cm$^{-1}$ disappears and no turbidity or precipitate appears when the reaction mixture is dissolved in n-pentane and is cooled.

* * * * *